US007114783B2

(12) United States Patent
Warren et al.

(10) Patent No.: US 7,114,783 B2
(45) Date of Patent: Oct. 3, 2006

(54) SPECIALIZED SEATING APPARATUS

(75) Inventors: Robert L. Warren, Solana Beach, CA (US); Ryan J. Matzinger, San Diego, CA (US)

(73) Assignee: SOTA Music, Inc., Solana Beach, CA (US)

( * ) Notice: Subject to any disclaimer, the term of this patent is extended or adjusted under 35 U.S.C. 154(b) by 0 days.

(21) Appl. No.: 11/100,096

(22) Filed: Apr. 5, 2005

(65) Prior Publication Data

US 2005/0253443 A1 Nov. 17, 2005

Related U.S. Application Data

(60) Provisional application No. 60/562,468, filed on Apr. 14, 2004.

(51) Int. Cl.
*A47C 7/14* (2006.01)
*A47C 9/00* (2006.01)

(52) U.S. Cl. ..... 297/452.41; 297/461; 297/DIG. 3; 5/654

(58) Field of Classification Search ..... 297/180.1, 297/180.14, 452.14, 452.18, 452.2, 452.41, 297/452.56, 452.65, 461, DIG. 3; 5/638, 5/653, 654
See application file for complete search history.

(56) References Cited

U.S. PATENT DOCUMENTS 484,367 A * 10/1892 Hicks ..... 297/DIG. 3 X
564,588 A * 7/1896 Burgess ..... 297/DIG. 3 X
576,419 A * 2/1897 Wilmot ..... 297/DIG. 3 X
2,216,818 A * 10/1940 Kuhlman ..... 297/461 X
3,125,377 A * 3/1964 Bridges ..... 297/DIG. 3 X
3,757,366 A * 9/1973 Sacher ..... 297/180.13 X
3,795,021 A * 3/1974 Moniot ..... 297/DIG. 3 X
4,160,299 A * 7/1979 Hilbern ..... 297/452.41 X
4,175,297 A * 11/1979 Robbins et al. ..... 297/180.11 X
4,391,009 A * 7/1983 Schild et al. ..... 297/180.11 X
5,016,302 A * 5/1991 Yu ..... 297/180.11 X
5,356,205 A * 10/1994 Calvert et al. ..... 297/454.41
5,561,875 A * 10/1996 Graebe ..... 297/180.13 X
5,590,428 A * 1/1997 Roter ..... 297/180.13 X
5,597,200 A * 1/1997 Gregory et al. ..... 297/180.13
5,690,389 A * 11/1997 Ekman et al. ..... 297/452.41
5,738,406 A * 4/1998 Deus ..... 297/200
6,070,943 A * 6/2000 Guery-Strahm ..... 297/452.41
6,109,688 A * 8/2000 Wurz et al. ..... 297/180.14
6,125,486 A * 10/2000 Rabon ..... 297/452.41 X
6,135,550 A * 10/2000 Tucho ..... 297/199
6,159,172 A * 12/2000 Gray et al. ..... 601/149
6,164,719 A * 12/2000 Rauh ..... 297/180.12

(Continued)

FOREIGN PATENT DOCUMENTS

EP 563820 A1 * 10/1993 ..... 297/452.41

(Continued)

*Primary Examiner*—Rodney B. White
(74) *Attorney, Agent, or Firm*—Lipsitz & McAllister, LLC

(57) ABSTRACT

The present invention provides a seating apparatus having an adjustable level of firmness. The seating apparatus comprises a base, an inflatable element arranged on the base, and a cover covering the inflatable element. Access means in communication with the inflatable element are provided, enabling inflation of the inflatable element for providing an adjustable firmness in the seating area. The inflatable element may comprise a ring having a center opening. The base may comprise a ring having a center opening coinciding with the center opening of the inflatable element. The cover may comprise a section of permeable material over the center opening. A fan may be affixed within the center opening for providing airflow through the center opening.

15 Claims, 4 Drawing Sheets

U.S. PATENT DOCUMENTS 6,209,159 B1 * 4/2001 Murphy ..... 5/654
6,234,578 B1 * 5/2001 Barton et al. ..... 297/452.41
6,328,385 B1 * 12/2001 Lau ..... 297/452.41
6,520,578 B1 * 2/2003 Jospa et al. ..... 297/452.41
6,616,238 B1 * 9/2003 Guery-Strahm ..... 297/452.41
6,679,557 B1 * 1/2004 Craft et al. ..... 297/452.41
6,682,145 B1 * 1/2004 Wilkerson et al. .. 297/452.41 X
6,702,388 B1 * 3/2004 Chiu ..... 297/452.41
6,786,273 B1 * 9/2004 Ichigaya ..... 297/180.14 X
6,832,817 B1 * 12/2004 Chiu ..... 297/452.41
2003/0234565 A1 * 12/2003 McCurdy ..... 297/452.41 X

FOREIGN PATENT DOCUMENTS

FR 2557441 A1 * 7/1985 ..... 297/452.41

* cited by examiner

SPECIALIZED SEATING APPARATUS

This application claims the benefit of U.S. Provisional Application No. 60/562,468, filed on Apr. 14, 2004.

BACKGROUND OF THE INVENTION

The present invention relates to a seating apparatus aimed primarily at musicians and others that are required to sit for extended periods of time while exerting themselves. In particular, the present invention provides a seating apparatus that provides the ability to set and adjust the firmness of the seat, as well as a means to allow for increased airflow through the seat.

Any professional relies on tools to perfect their trade. Certainly musicians are among the most visible in the use of their tools. The most evident tools are the instruments they play. There are, however, many tools used by musicians that go largely unnoticed and, therefore, remain largely untouched by innovation.

One such tool is the focus of this invention, namely the seat used by drummers and other performers during their performance. Commonly referred to as a "throne" by drummers and percussionists to denote its prominence, the seat is an integral part of a tool kit that is largely ignored by anyone but the user.

The seat or throne, whether the traditional fabric or vinyl covered foam or the adjustable type as described herein, is critical to the user's ability to perform. Not only does the throne provide a place to sit, but, particularly in the case of a drummer, its position is key to the ability of a drummer to perform as he has practiced. That is, if a drummer were to sit on any chair or stool that did not provide the correct position he may have to struggle mightily to perform as expected.

Because performer seating is not well appreciated, there has been little innovation in the art, particularly in seating available for a drummer. For simplicity, the description of the invention herein will focus on example embodiments particularly suited for seating for a drummer. However, those skilled in the art will appreciate that the present invention is applicable to virtually any seating application, whether for a performer or others.

For a drummer's seat, there are two basic prior art models available today: (1) a simple round, padded stool seat and; (2) a padded stool seat that resembles an old-fashioned motorcycle seat. Still other performers rely on rectangular benches. The only variations in these models, aside from the firmness of the foam padding, is the design of the base. Such bases range from more traditional collapsible hardware type bases to those similar to common desk chairs. While the choice of the base is largely made at the time of purchase, based on specific requirements, adjustability is the primary variable in the base.

Unfortunately, a choice of the seat firmness also must be made at the time of purchase. There is no ability to accommodating necessary changes in seat firmness without the procurement of another seat. Such changes might be required by different performers using the same kit, as in the case of a bandstand arrangement, or by the same performer who wishes some change during a long performance to help relieve fatigue.

It would be advantageous to provide a seat having an adjustable firmness level. It would be further advantageous to provide such an adjustable firmness level through the use of an inflatable bladder located in the seat cushion. It would also be advantageous to provide for cooling or heating of the seat cushion.

The present invention provides the foregoing and other advantages.

SUMMARY OF THE INVENTION

The present invention provides a seating apparatus having a seating area with an adjustable firmness level. It is important to note that while the seating apparatus is described herein as being particularly suited for drummers, the seating apparatus of the present invention is equally usable by any number of musicians or others required to remain seated for extended periods, including office workers, factory workers, restaurant workers, medical personnel, students, teachers, and the like.

In an example embodiment of the present invention, a seating apparatus is provided which comprises a base, an inflatable element arranged on the base, and a cover covering the inflatable element. Access means in communication with the inflatable element are provided, enabling inflation of the inflatable element for providing an adjustable firmness in a seating area of the seating apparatus.

The inflatable element may be segmented into segments, each segment being separately inflatable to provide varying levels of firmness over the seating area.

In a further example embodiment, the inflatable element may comprise a ring having a center opening. In such an embodiment, the base may comprise a ring having a center opening coinciding with the center opening of the inflatable element.

The cover may comprise a section of permeable material over the center opening. The cover may be removable.

A fan may be affixed within the center opening for providing airflow through the center opening. The fan may include a heating element for generating a heated airflow through the center opening.

The access means may comprise a valve stem adapted to accept a pump device for inflating the inflatable element. The pump device may be a separate unit, or integrated into the design of the seat. For example, the pump device may be attached to the base and connected to the access means for inflating the inflatable element.

The access means may also enable deflation of the inflatable element. The seating apparatus may alternatively include a release valve for deflating the inflatable element. In addition, a pressure release valve may be provided for preventing over-inflation of the inflatable element.

The seating apparatus may further comprise a padding component. The padding component may be arranged in at least one of: (i) a position above the inflatable element; (ii) a position between the inflatable element and the base; and (iii) a position inside the inflatable element.

A removable backrest may be attached to the base. The backrest may include a second inflatable element for providing adjustable levels of firmness in the backrest. Removable armrests may also be attached to the base. A position of the armrests may be adjustable. A stand may be attached to the base. The stand may be adjustable in height and collapsible for storage and transport.

In a further example embodiment of the present invention, a seating apparatus is provided which comprises a base, a padding component arranged on the base and having a central opening therethrough, and a cover covering the padding component and the central opening. The cover may comprise a permeable material at least in an area of the central opening. The central opening may be adapted to allow airflow therethrough for heating or cooling a seating area of the seating apparatus. A fan may be affixed within the center opening for generating airflow through the center opening.

BRIEF DESCRIPTION OF THE DRAWINGS

The present invention will hereinafter be described in conjunction with the appended drawing figures, wherein like reference numerals denote like elements, and.

DETAILED DESCRIPTION

The ensuing detailed description provides exemplary embodiments only, and is not intended to limit the scope, applicability, or configuration of the invention. Rather, the ensuing detailed description of the exemplary embodiments will provide those skilled in the art with an enabling description for implementing an embodiment of the invention. It should be understood that various changes may be made in the function and arrangement of elements without departing from the spirit and scope of the invention as set forth in the appended claims.

Figure 1:
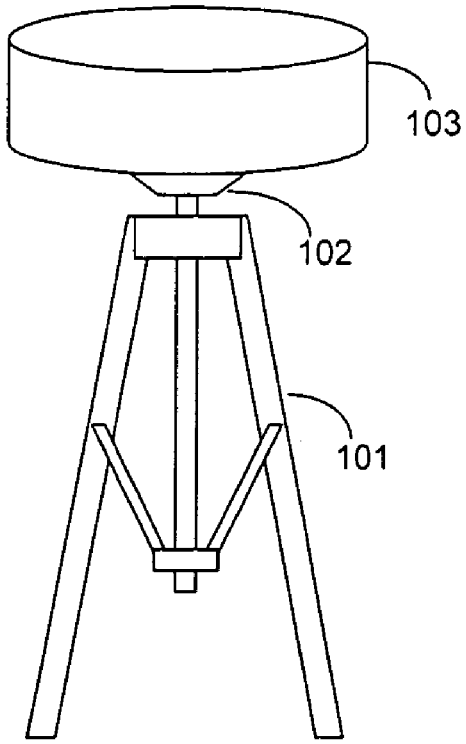
FIG.1 (PRIOR ART)
FIG. 1 shows a prior art example of a drummer's seat.

For simplicity of description, one may consider a typical prior art drummer's seat as a basis for comparison with the present invention. A typical prior art drummer's seat is shown in FIG. 1. The typical drummer's seat has a collapsible stand 101 made of heavy-duty steel. The stand 101 is most typically the same structure as other drum hardware and cymbal stands. Connected by a typical hardware element 102 and sitting atop the stand 101 is a simple round padded seat 103.

Figure 2:
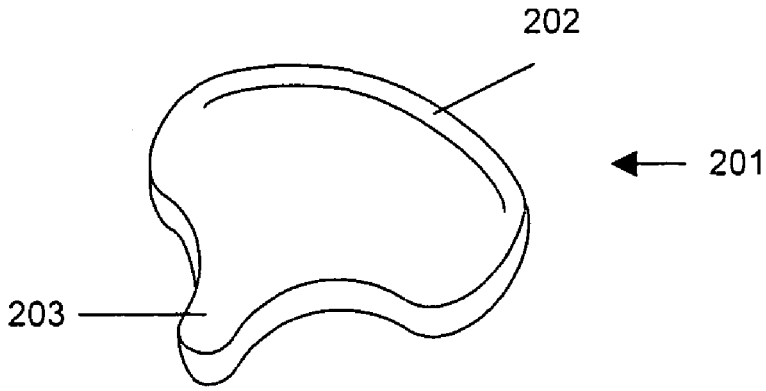
FIG. 2 (PRIOR ART)
FIG. 2 shows a further prior art example of a drummer's seat.

A further example of a prior art drummer's seat 201 is shown in FIG. 2. Such a prior art seat 201 is in the shape of an old-fashioned motorcycle seat. The seat 201 is padded, but somewhat larger in diameter with a ridge along a portion of the back edge 202 and contoured in a front section 203 to allow for freer leg movement.

Figure 3:
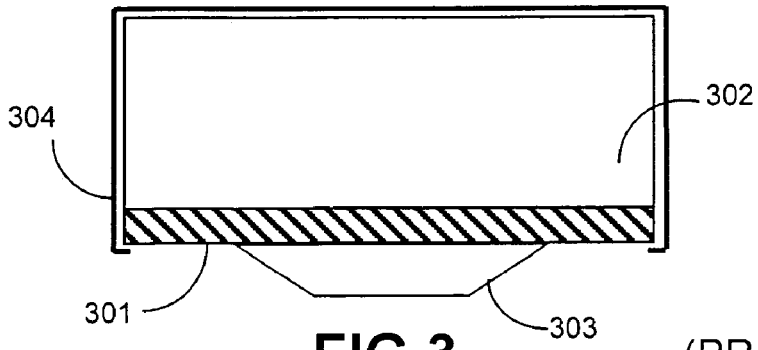
FIG.3 (PRIOR ART)
FIG. 3 shows a cross-section of the prior art drummer's seat of FIG. 1.

In either prior art version, the design of the seat cushion is quite similar. As shown in a cross-section in FIG. 3, a base 301 of such a prior art seat, typically made of wood or fiberglass, provides the foundation for a molded foam seat cushion 302. The base 301 is connected to the stand via a hardware device 303. A cover 304 of fabric, vinyl, or similar material, with seams to accommodate the shape of the molded foam, covers the foam cushion 302 and the edge of the hard base 301. Often the cover 304 is stapled along the bottom side of the hard base 301 to provide an upholstered appearance.

The connection of the base 301 of the seat to the stand may be by various means. For example, the hardware device 303 may comprise a mounting bracket attached to the bottom of the base 301 with a fitting for connection to a stand, such as stand 101 of FIG. 1. This fitting may allow for a friction clamp to prevent separation of the stand and seat or may interact with the stand with one part acting as a receptacle for a protrusion of the other part.

Aside from the general shape, size and color of a seat, the primary choice to be made by one acquiring a seat is firmness. This is quite similar to the periodic issue of choosing a mattress, which many people face on a regular basis. The implications of having to choose a specific firmness requires that the user either utilizes multiple seats for different firmness needs or sacrifices any flexibility in firmness. Additionally, multiple firmness models in each design require that manufacturers produce many variations and that these models be carried throughout the distribution chain and to retail outlets. These factors result in undue cost and confusion to the consumer.

An additional issue with prior art drummer seats is that, like most covered seating surfaces, after a short period of use, heat builds up and makes the seat uncomfortable. In the case of drummers, who are very active during a performance, heat and perspiration are quick to form and accumulate on the seating surface.

The present invention provides a solution to the foregoing problems. The present invention can be applied to the standard round seat configuration shown in FIG. 1, to the motorcycle shaped seat configuration shown in FIG. 2, and to most other seat configurations. The typical stand 101 remains usable for the purposes of this invention. However, those skilled in the art will appreciate that various types of stands may be used in connection with the present invention.

Figure 4:
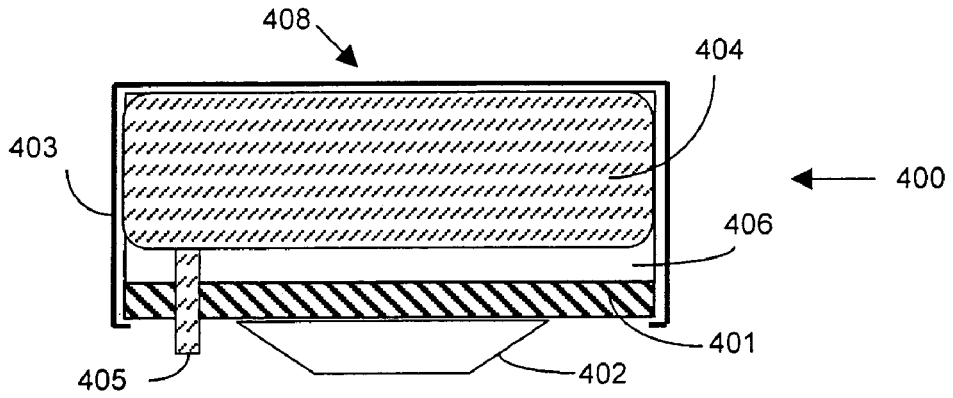
FIG. 4 shows a cross-section of an example embodiment of a seating apparatus in accordance with the present invention.

In accordance with an example embodiment of the present invention as shown in cross-section in FIG. 4, instead of only foam providing the cushion, an inflatable element 404 is introduced and made integral to the seating apparatus 400. A base 401 provides a connection point for hardware mounting device 402 and an attachment point for fabric cover 403. The inflatable element 404 may comprise an inflatable bladder encased in the cover 403. Typically made of rubber or plastic, the inflatable element 404 can be filled with any type of inflation element, including gas, fluid or solid. This inflatable element 404 may be comprised of a single inflatable element, multiple inflatable elements or a segmented inflatable element to provide the adjustment means. The inflatable element 404 may have an access means 405 to introduce or remove air or other substance to effect inflation or deflation of the inflatable element 404, causing the seating area 408 to become firmer or softer. An additional padding component 406 may be provided under the inflatable element 404. Alternatively, the padding component 406 may be placed on top of the inflatable element 404. Additionally, a padding component 406 may be provided both under and on top of the inflatable element 404. Further, one skilled in the art will appreciate that the padding component 406 may be provided inside the inflatable element.

Figure 5:
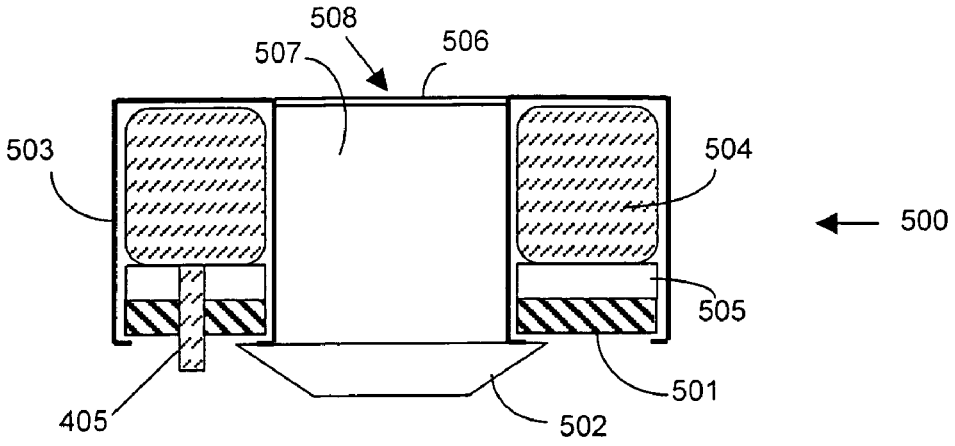
FIG. 5 shows a cross-section of a further example embodiment of a seating apparatus in accordance with the present invention.

In a further example embodiment as shown in cross-section in FIG. 5, an opening 507 may be provided in the center of the seating apparatus 500. The opening may extend through the inflatable element 504. Further, the opening 507 may also extend through the optional padding component 505, the base 501, and the mounting device 502. A fabric cover 503 may cover the inflatable element 504 and an optional padding component 505. The cover 503 may incorporate a section 506 of permeable material across the opening 507 in the center of the seating area 508, such as a webbed fabric. Such permeable material allows for ready airflow through the opening 507, as well as the passing of perspiration and other fluids that the user does not want to collect on the seating area 508.

It should be noted that the fabric cover 503, whether incorporating the permeable material or not, may be removable. This capability would provide additional flexibility to the user by allowing the user to change colors or texture of the fabric cover 503, and/or to wash the cover 503. Additionally, it can allow for easy repair or replacement of the inflatable element 504 if necessary. For example, the cover 503 may be affixed via temporary means like Velcro or pull-strings. This feature allows the user to alter the appearance of the seat apparatus 500 to fit the setting, the decor, or his whim.

Figure 6:
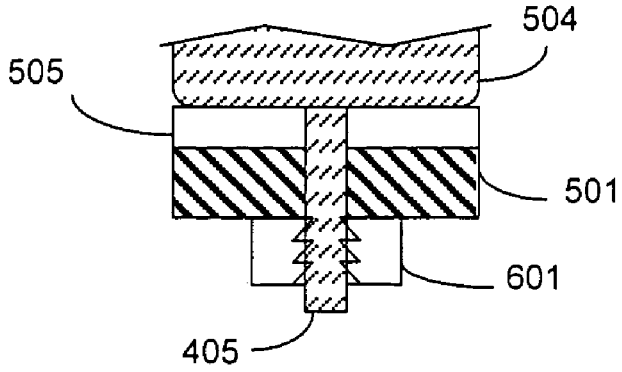
FIG. 6 shows an example embodiment of an access means for an inflatable element of a seating apparatus in accordance with the present invention.

The inflatable element access means 405 can be located at any point on the inflatable element 404, 504. Practically, the access means 405 may be located through a passage in the base 401, 501 as shown in FIGS. 4 and 5. As shown in FIG. 6, the access means 405 may be attached to the base 401, 501 by an attachment element 601, such as a locking nut, a friction fit, or the like, in order to keep the access means 405 in place during inflation or deflation.

In an exemplary embodiment of the present invention, a ring made of suitably hard material, such as wood, plywood, plastic, fiberglass, metal, or the like, may provide the base 501 for the seat. This base 501 may be attached to a stand (e.g., stand 101 of FIG. 1) with a mounting device 402, 502. Those skilled in the art will appreciate that the stand and mounting device can take many forms and thus are not described further herein.

An optional padding component 505 may be provided on top of the base 501. This padding component 505 may comprise, for example, a high-density foam. The inflatable element 504 may be provided on top of the pad. Both the padding component 505 and the inflatable element 504 may be provided, respectively, in the same ring shape as the base 501 (e.g., with a circular shape having a center opening 507). The padding component 505 may provide a nonabrasive interface between the inflatable element 504 and the base 501. Additionally, the padding component 505 provides padding if the inflatable element 504 does not remain inflated.

The inflatable element 504 may be made of rubber or similar material that can withstand internal pressures from inflation and the weight of a user sitting on the seating area 508. Further, the inflatable element 504 may be segmented such that different segments can be inflated to different levels, thereby providing different levels of firmness in different areas of the seating area 508. Each segment may be provided with its own access means 405 for providing independent adjustability of the firmness level of each segment.

The inflatable element 504 may also include a means for adding whatever inflation element is being used for inflation. For the purposes of this example, air may be used to inflate the inflatable element 504 via the access means 405 protruding through the base 501. This access means 405 may, for example, comprise a valve stem of the type commonly used on rubber inner tubes for bicycle tires (e.g., a Schraeder or Presta valve). Other types of valves well known for use with inflatable devices could alternatively be provided. The access means 405 may also operate as a release valve to release the inflation element from the inflatable element.

The ring formed by the base, padding component, and inflatable element is covered with a cover 503 made of fabric, such as a heavy-duty vinyl, in a manner that maintains the ring form. A permeable section 506 of webbed fabric may span across the opening 507 of the ring and be attached to the vinyl fabric cover 503 around the outer edge of the ring.

Once the seating apparatus 500 is assembled and mounted atop a stand, inflation can begin. With the use of a pump device, the user can add air to reach the desired level of firmness. With a valve built into the access means 405, once the inflation is complete, the pump can be separated from the access means 405 if desired. The seating apparatus 500 is then ready to use.

Figure 7:
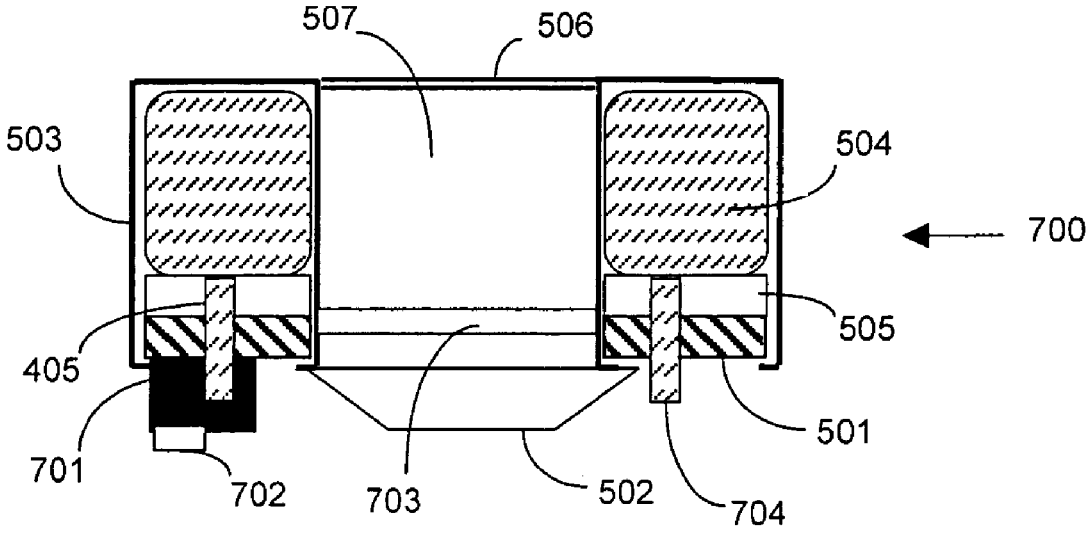
FIG. 7 shows a further example embodiment of a seating apparatus in accordance with the present invention.

The pump device may comprise an independent pump that can be attached to the access means 405. In an alternate example embodiment as shown in FIG. 7, a pump device may be incorporated into the seating apparatus 700. For example, a mechanical or electric pump 701 may be provided on the underside of the base 501. In this example, the pump 701 is connected directly to the inflatable element access means 405 thereby eliminating the need to use a separate pump. An incorporated pump 701 can include a switch 702 to control the inflow and outflow of air to the inflatable element 504. The pump 701 may be plugged into an electrical outlet or battery operated. A separate pressure release valve 704 may be provided for preventing over-inflation of the inflatable element 504. Alternatively, a pressure release valve may be integrated into the access means 405.

In another example embodiment of the present invention, air may be forced through the opening 507 to allow for heating or cooling, as required. The airflow may be provided by a fan 703 provided at the bottom of the opening 507. A heating element may be provided integral to the fan 703 in order to provide heating of the seating area 508.

Figure 8:
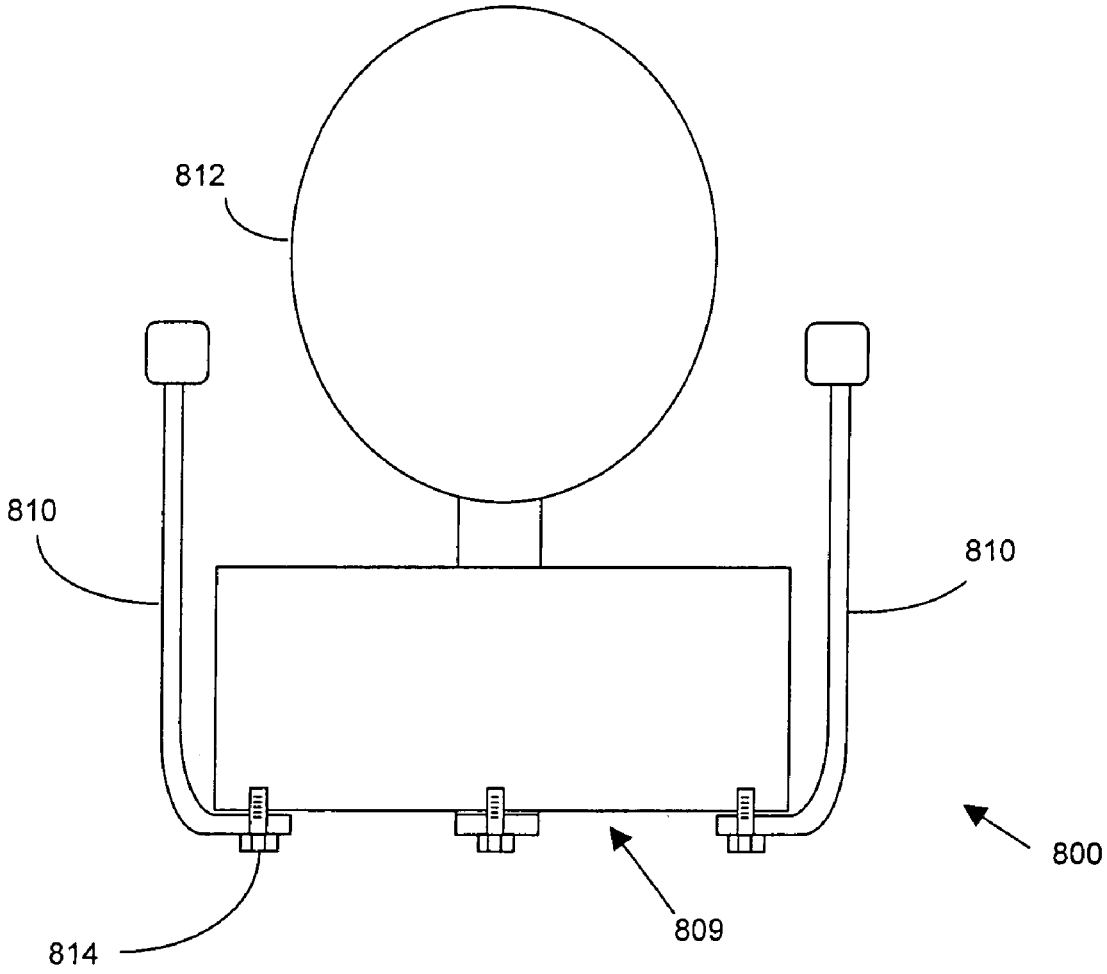
FIG. 8 shows an additional example embodiment of a seating apparatus in accordance with the present invention.

In a further example embodiment of a seating apparatus 800 is shown in FIG. 8. In such an embodiment, arms 810 and a backrest 812 may be removably attached to the bottom 809 of the seating apparatus (e.g., via the base of the seating apparatus 800). It should be appreciated that the arms 810 and backrest 812 can be attached to base 401 or base 501 of the embodiments discussed above. For example, the arms 810 and backrest 812 may be removably attached to base 401, 501 via nuts and bolts 814. Other means of attachment will also be apparent to those skilled in the art.

Such an embodiment as shown in FIG. 8 will provide the option of easily installing or removing arms 810 and/or the backrest 812 to fit the application. For instance, a studio application that requires long sessions with long periods of inactivity might warrant the use of a backrest for the seat. The backrest may include an inflatable element for adjusting firmness. Such an inflatable element may operate in the same manner as the inflatable elements 404 and 504 described above.

There are numerous advantages provided by the present invention. One of the most salient advantages is that one configuration may be used by different performers with varying firmness requirements. Similarly, a single performer may adjust the firmness of the seat while performing. This can provide many benefits, including relief from fatigue and potential long-term problems due to bad posture caused by a standard seat. From manufacturing to inventory to sales to actual use, a seat with such flexibility can obviate the need to build and stock units having different seating firmnesses.

In addition to the firmness adjustability provided by the present invention, the fact that a performer can enjoy the design with reduced heat and perspiration build up is a substantial further advantage. This can make a long performance more comfortable, particularly in hot locations.

It should now be appreciated that the present invention provides an advantageous seating apparatus having an adjustable firmness level and built in heating and cooling capabilities.

Although the invention has been described in connection with various illustrated embodiments, numerous modifications and adaptations may be made thereto without departing from the spirit and scope of the invention as set forth in the claims.

What is claimed is:

1. A seating apparatus, comprising:

a rigid base having a first central opening;

an inflatable element arranged on the base and having a second central opening aligned with said first central opening of said base;

a padding component having a third central opening aligned with said first and second central openings;

a cover covering the inflatable element and said padding component, said cover comprising an air permeable material at least in the area of the central opening; and access means in communication with the inflatable element enabling inflation of the inflatable element for providing an adjustable firmness in a seating area of the seating apparatus;

wherein said central openings and said air permeable cover permit airflow through said seating apparatus.

2. A seating apparatus in accordance with claim 1, wherein said inflatable element is segmented into segments, each segment being separately inflatable to provide varying levels of firmness over the seating area.

3. A seating apparatus in accordance with claim 1, further comprising a fan affixed within the center opening for providing airflow through the center opening.

4. A seating apparatus in accordance with claim 3, wherein said fan comprises a heating element for generating a heated airflow through the center opening.

5. A seating apparatus in accordance with claim 1, wherein said cover is removable.

6. A seating apparatus in accordance with claim 1, wherein said access means comprises a valve stem adapted to accept a pump device for inflating said inflatable element.

7. A seating apparatus in accordance with claim 1, further comprising a pump device attached to said base and connected to said access means for inflating said inflatable element.

8. A seating apparatus in accordance with claim 1, wherein said access means enables deflation of the inflatable element.

9. A seating apparatus in accordance with claim 1, further comprising a release valve for deflating the inflatable element.

10. A seating apparatus in accordance with claim 1, further comprising a pressure release valve for preventing over-inflation of said inflatable element.

11. A seating apparatus in accordance with claim 1, wherein said padding component is arranged in at least one of: (i) a position above the inflatable element; and (ii) a position between the inflatable element and the base.

12. A seating apparatus in accordance with claim 1, further comprising:

at least one of: (1) a removable backrest attached to said base: and (2) removable armrests attached to said base.

13. A seating apparatus in accordance with claim 12, wherein said backrest includes a second inflatable element for providing adjustable levels of firmness in said backrest.

14. A seating apparatus in accordance with claim 12, wherein:

said removable armrests are attached to said base; and a position of said armrests is adjustable.

15. A seating apparatus in accordance with claim 1, further comprising a stand attached to said base, said stand being adjustable and collapsible.

* * * * *

UNITED STATES PATENT AND TRADEMARK OFFICE

CERTIFICATE OF CORRECTION

PATENT NO. : 7,114,783 B2
APPLICATION NO. : 11/100096
DATED : October 3, 2006
INVENTOR(S) : Warren et al.

It is certified that error appears in the above-identified patent and that said Letters Patent is hereby corrected as shown below:

Column 7, line 25: Add an --s-- at the end of the word "opening" so that it reads -- openings --.

Signed and Sealed this

Twelfth Day of December, 2006

JON W. DUDAS
*Director of the United States Patent and Trademark Office*